US009835331B2

(12) United States Patent
Piret et al.

(10) Patent No.: US 9,835,331 B2
(45) Date of Patent: Dec. 5, 2017

(54) CERAMIC BOTTOM LINING OF A BLAST FURNACE HEARTH

(75) Inventors: Jacques Piret, Liege (BE); Gilles Kass, Soleuvre (LU)

(73) Assignee: PAUL WURTH S.A., Luxembourg (LU)

( * ) Notice: Subject to any disclaimer, the term of this patent is extended or adjusted under 35 U.S.C. 154(b) by 698 days.

(21) Appl. No.: 13/994,833

(22) PCT Filed: Dec. 16, 2011

(86) PCT No.: PCT/EP2011/073119

§ 371 (c)(1),
(2), (4) Date: Jun. 17, 2013

(87) PCT Pub. No.: WO2012/080496

PCT Pub. Date: Jun. 21, 2012

(65) Prior Publication Data

US 2013/0276680 A1 Oct. 24, 2013

(30) Foreign Application Priority Data

Dec. 17, 2010 (LU) ..... 91 767

(51) Int. Cl.
*F23M 5/00* (2006.01)
*B28B 11/24* (2006.01)
(Continued)

(52) U.S. Cl.
CPC ..... *F23M 5/00* (2013.01); *B28B 11/24* (2013.01); *C21B 7/06* (2013.01); *F27D 1/003* (2013.01); *F27D 1/0006* (2013.01); *C21C 5/44* (2013.01)

(58) Field of Classification Search
CPC .... C21B 7/06; C21C 5/44; F23M 5/00; F27D 1/003; F27D 1/0006; B28B 11/24
(Continued)

(56) References Cited

U.S. PATENT DOCUMENTS 4,272,062 A 6/1981 Fuziwara et al.
4,360,506 A * 11/1982 Paris ..... C01B 21/0826 106/811

FOREIGN PATENT DOCUMENTS

CN 2263655 * 10/1997 ..... C21C 5/44
CN 2263655 Y 10/1997
(Continued)

OTHER PUBLICATIONS

Japanese Examination Report dated Apr. 28, 2015 re: Japanese Application No. P2013-543823.
(Continued)

*Primary Examiner* — Jessee Roe
*Assistant Examiner* — Michael Aboagye
(74) *Attorney, Agent, or Firm* — Cantor Colburn LLP

(57) ABSTRACT

A hearth for a metallurgical furnace, in particular for a blast furnace, the hearth including a wall lining and a bottom lining of refractory material for containing a molten metal bath, the bottom lining including a lower region and an upper region that is arranged to cover the top of the lower region and that is built of ceramic elements, the ceramic elements of the upper region being made of microporous ceramic material including a granular phase made of a silico-aluminous high alumina content granular material and a binding phase for binding grains of said granular material, said microporous ceramic material having thus an maintaining permanently a thermal conductivity lower than 7 W/m.° K.

15 Claims, 4 Drawing Sheets

(51) Int. Cl.

| | |
|---|---|
| ***C21B 7/06*** | (2006.01) |
| ***F27D 1/00*** | (2006.01) |
| *C21C 5/44* | (2006.01) |

(58) Field of Classification Search
USPC ..... 266/200, 193, 282, 283, 284, 286, 280, 266/285; 373/72, 75, 76; 432/4, 248, 432/119, 103, 105; 110/336; 264/44
See application file for complete search history.

(56) References Cited

FOREIGN PATENT DOCUMENTS

| | | | | |
|---|---|---|---|---|
| CN | 1405119 | * | 3/2003 | ..... C21C 5/44 |
| CN | 1405119 | A | 3/2003 | |
| CN | 1686922 | A | 10/2005 | |
| CN | 20148577 | U | 5/2010 | |
| EP | 0293600 | A1 | 12/1988 | |
| GB | 1598370 | | 9/1981 | |
| JP | PH10212511 | A | 8/1998 | |
| JP | 2009242122 | A | 10/2009 | |
| WO | 2009072652 | A2 | 6/2009 | |

OTHER PUBLICATIONS

International Preliminary Report on Patentability for corresponding application No. PCT/EP2011/073119 filed Dec. 16, 2011;Report dated Jan. 23, 2013.
International Search Report for corresponding application No. PCT/EP2011/073119 filed Dec. 16, 2011; dated Jan. 27, 2012.
Chinese Office Action for corresponding appication 201180060873.6 filed Dec. 16, 2011; dated Apr. 1, 2014.

* cited by examiner

CERAMIC BOTTOM LINING OF A BLAST FURNACE HEARTH

TECHNICAL FIELD

The present invention generally relates to a refractory lining of a metallurgical vessel, e.g. of the furnace hearth of a blast furnace for pig iron production. More particularly, the present invention relates to the use of ceramic material in the upper region of the bottom lining of a hearth that contains liquid hot metal during operation.

BACKGROUND ART

It is well known in the field of blast furnace design to use refractory materials, such as carbon blocks, in building the bottom-lining of the hearth. Since it contains liquid hot metal, the working conditions of the hearth lining are severe in view of high temperature, mechanical abrasion, chemical attack and of infiltration of liquid hot metal. The current trend toward increasing the production rate of blast furnaces renders the working conditions even more severe. In order to increase the working life of the bottom lining especially, a known solution consists in providing an uppermost layer of ceramic material, such as fired bricks, e.g. andalusite bricks with mullite bond, on top of the main refractory layer, which is typically made of thermally conductive carbon refractory blocks.

The upper layer of ceramic material, sometimes called the ceramic pad, enhances among others the beneficial effect of the bottom cooling system. The bottom cooling system cools the thermally conductive refractory elements of the bottom lining to achieve a thermal equilibrium, in which the solidification isotherm (the "freeze level"), that is the level at which pig iron solidifies, is located as high as possible in the bottom lining. The ultimate goal is to ensure that any molten cast iron, which would eventually migrate down into the bottom lining, would be solidified at a location as high as possible, preferably at the level of the uppermost ceramic portion (the ceramic pad) if any. Providing an additional thermally insulating barrier of ceramic elements between the bath and the main refractory of the bottom obviously contributes to achieving the latter aim. It can be easily understood that the thermal conductivity of the ceramic layer should be as low as possible. Consequently, the ceramic top layer's main function is to protect the underneath refractories against erosion and generally to reduce their working temperature, which is known to reduce wear.

It has recently been observed however that the approach of providing an uppermost layer of protective ceramic refractory still presents shortcomings. In fact, besides unavoidable long-term wear-off of the ceramic layer, it has been observed that the solidification isotherm starts to progressively descend down into the carbon part of the bottom lining even when no significant reduction in the thickness of the ceramic layer has yet occurred.

BRIEF SUMMARY

The invention provides an improved ceramic layer for the upper region of the bottom lining, which layer has a more durable protective effect on the lower region.

The present invention proposes a hearth for a vessel in metallurgical industry, especially a hearth for a furnace containing low-viscosity molten metal, in particular for a blast furnace. The hearth comprises a wall lining and a bottom lining that are made of refractory material for containing a molten metal bath. The bottom lining has a lower region and an upper region that includes a layer of ceramic elements, e.g. a layer in form of a masoned pavement construction of separate building units such as bricks or, more preferably, larger blocks. The layer of ceramic elements is dimensioned to cover the lower region.

By "ceramic material", it is understood the commonly agreed definition for a refractory ceramic material, i.e. a material resistant to fire and based on ceramic oxides for its granular phase and on ceramic oxides or non-oxide components as far as the binding phase between the grains is concerned. Refractory materials having their granular phase mainly made of non-oxide materials, like carbon, or of silicon carbide are not considered in this patent for technical reasons which will appear in the development of this document.

The invention provides ceramic elements made of microporous ceramic material, comprising a granular phase made of a silico-aluminous high alumina content granular material and a binding phase for binding grains of said granular material. The microporous ceramic material has typically a thermal conductivity lower than 7 W/m.° K, preferably lower than 5 W/m.° K.

The granular phase comprises one or more of the following: andalusite, chamotte, corundum, synthetic mullite. The binding phase comprise a nitrided bond, preferably a SiAlON bond.

The microporous ceramic elements according to the invention form a protective layer or interface that completely covers the conventionally designed lower region of the bottom lining. Slight non-homogeneity in porosity of the bottom lining taken as a whole can result from minor non-microporous regions formed by the joints between the bricks or between the blocks which are necessary for known thermo-mechanical reasons. However, such slight non-homogeneity in porosity in the bottom lining is tolerable. In any case, the elements per se comprise, to a technically feasible extent, exclusively of microporous ceramic material.

For a better understanding of what is determining on the ground of the micro-porosity, it shall be remembered that it is the properties of the matrix phase which allow to declare that the material is microporous or not; per se, the granular phase, which represent about 80% of the material, is not really porous or insignificantly porous, that is mostly closed porosity if any, and does not interfere with the microporous behavior of the material; nevertheless, when it is said that a given material is microporous, the expression refers to the material as a whole, because it is utilized as a whole.

It has been observed in the course of developments leading to the present invention that, with progressing service life, the ceramic refractory elements themselves are gradually infiltrated by molten cast iron. This phenomenon becomes more pronounced with increasing ferrostatic head and higher furnace operating pressures. It is theorized that this phenomenon is due to inherent porosity and permeability of conventional ceramics. Accordingly, thermal conductivity of the upper ceramic layer increases with time due to an increasing pig iron content. As a consequence, the solidification isotherm detrimentally progresses down into the bottom lining with time. In order to overcome this drawback, the present invention suggests significantly reducing the permeability of the ceramic elements used in the top layer, and more specifically to use microporous ceramics. In this regard it will be understood, permeability is not necessarily nor always an ascending function of porosity. In certain circumstances it is known that one has to increase porosity in order to reduce permeability.

Porous materials can be characterized by their permeability (intrinsic permeability), i.e. the degree to which a material is able to transmit a fluid substance (allows permeation). Permeability may be stated in metric perms or in US perms (about 0.659 of a metric perm). Hereinafter, permeability is stated in metric perms.

According to one aspect of the invention, the microporous ceramic material of the protective layer has a permeability that is less than or equal to 2 nanoperms, and more preferably less than or equal to 1 nanoperm. Such low permeability significantly reduces or even completely avoids permeation by pig iron. A suitable permeability measurement method is defined in the ISO 8841 (version 1991) standard.

As is well known, porous materials are also classified by way of the mean (average) width of their pores. In the present context (and contrary e.g. to IUPAC definition), refractory materials are considered "microporous", when they have pores presenting a mean width of less than 2 μm. According to an aspect of the invention, the ceramic elements thus preferably have a mean pore width of less than or equal to 2 μm, more preferably less than or equal to 1 μm.

According to one embodiment, the protective layer is an assembly, e.g. a masonry-like construction similar to a pavement, that completely covers the total free surface of the lower region, i.e. the generally horizontal top surface of the lower region that is delimited in circumference by the wall lining. Theoretically, the protective layer could be built in conventional manner of comparatively small bricks. Bricks typically have a volume of <20 dm3 (0.02 m3), e.g. dimensions smaller than or equal to 100×250×500 mm, and a weight in the order of 40 kg or less. According to a preferred embodiment of the invention however, the layer is an assembly built to a large extent of comparatively large blocks. In the border region adjacent the wall lining, smaller elements may be used of course. In the present context, in contrast to bricks, the expression block refers to elements that have a total volume of at least 20 dm3 (0.02 m3), e.g. dimensions exceeding 400 mm or even 500 mm for the height, which corresponds to the height or thickness of the ceramic bottom layer (or pad), exceeding 200 mm in width (in circumferential direction around the furnace axis) and lengths (in radial direction) in excess of 500 mm, and a weight that can largely exceeds 50 kg.

The wall lining of the hearth may comprise a radially innermost additional assembly, e.g. a masoned circumferential wall, of ceramic elements that form a ceramic cup together with the layer of ceramic elements for containing the molten cast iron. The term "innermost" refers to "radially innermost" hereinafter. The additional assembly may be made of bricks or, preferably, of blocks. In a preferred embodiment of the ceramic cup, the ceramic elements of the additional assembly are also based on microporous ceramic material so that the entire ceramic cup is formed by microporous material.

Conventional ceramic refractory materials are typically mesoporous and relatively permeable (>10 nanoperm). There exist various known processes for obtaining microporosity by reducing the permeability of ceramic materials.

The ceramic elements are preferably obtained from prefabricated elements, e.g. conventionally cast ceramic blocks. In principle, microporosity could be achieved by hydraulic binding (e.g. using a hydraulic calcium aluminate cement). When using hydraulic binding, the prefabricated ceramic elements can be based for instance on silico-aluminous high alumina content granular material, e.g. corundum (crystalline form of aluminum oxide $Al_2O_3$ with traces of iron, titanium and chromium) or chamotte or andalusite granular material or fireclay synthetic mullite. In any cases, fine particles in between the grains confer a microporous character that remains stable when exposed to high temperatures.

More preferably however, in accordance with a further aspect, the ceramic elements contain suitable fine additives which, once treated by baking in nitrogen atmosphere ("nitrogen firing" or "nitride hardening") provide a high-temperature resistant permanent microporosity. In addition to decreasing the mean free width of the pores and thereby "impermeating" the material, this treatment can provide ceramic material, in particular SiAlON ceramics, with a better resistance to chemical attack, e.g. by alkaline substances, than non-nitrided ceramic materials. Large microporous ceramic elements are preferred and obtained by baking in nitrogen atmosphere of prefabricated blocks. Suitable prefabricated blocks can be based on high alumina content granular material. More preferably however, in view of reduced cost and reduced thermal conductivity, the blocks can be based on andalusite or chamotte granular material, e.g. chamotte with an $Al_2O_3$ content of 55-65% by weight, in particular 60-63% by weight, or also synthetic mullite. These different alternatives are considered to confer microporosity that remains reliably stable at high temperatures in excess of 1400° C. Preferably, the prefabricated blocks are composed so as to obtain a microporous SiAlON bonded ceramic, i.e. a sort of matrix (or bonding phase) made of "ceramic alloy" based on the elements silicon (Si), aluminum (Al), oxygen (O) and nitrogen (N), introduced adequately into the grog (initial mix before baking), which is subsequently baked in nitrogen atmosphere. Whereas SiAlON bonded ceramics are known for their resistance to wetting or corrosion by molten non-ferrous metals, they have also been found beneficial in case of ferrous metal, e.g. in a pig iron producing blast furnace.

According to a further aspect, which is also independent of the actual use of the ceramic elements, the ceramic elements of the upper region can comprise large-size blocks having a first part made of ceramic material baked in nitrogen atmosphere, said first part having an upper side and a lower side and comprising at least one blind hole made at said lower side, and a second part made of a refractory material rammed in said blind. The blind holes are arranged so that any point located in the ceramic material of the first part is at a distance from a surface of said first part lower than a maximum penetration depth of impermeation achievable by the baking process used for producing said blocks. In fact, such blind holes allow a more thorough penetration or diffusion of nitrogen into the blocks during the baking so that this special design allows producing microporous large-size blocks, e.g. measuring more than 200×400×500 mm, by baking in nitrogen atmosphere, the blind holes being then filled by a ramming material.

In known manner, the lower region of the bottom lining usually comprises a carbon refractory construction. Typically, the lower region includes, from the bottom to the top, a ramming mass, a safety graphite layer and a thermally conductive carbon refractory layer.

As will be understood, the present invention is particularly applicable to the construction of a hearth of a blast furnace, in particular the bottom lining thereof.

According to a further aspect, the ceramic elements are large-size ceramic blocks disposed in a herringbone pattern.

According to a first embodiment, the wall lining comprise, at the same level as said upper region, refractory blocks matching with said large-size ceramic blocks in said herringbone pattern, each alignment or group of alignments of ceramic blocks prolonging toward the periphery of the wall lining by one said refractory block.

According to a second embodiment, the wall lining comprise, at the same level as said upper region, an first annular row of refractory blocks disposed circumferentially side by side, and a second annular row of microporous ceramic blocks disposed circumferentially side by side is disposed between the first annular row of refractory blocks and the large-size ceramic blocks disposed in a herringbone pattern.

The ceramic elements can also be large-size ceramic blocks disposed in concentric annular rows wherein each of said annular rows is constituted of microporous ceramic blocks disposed circumferentially side by side, and the wall lining comprise, at the same level as said upper region, an annular row of refractory blocks disposed circumferentially side by side, the outer annular row of ceramic blocks being joined to said annular row of the wall lining by a ramming material.

In any of the above embodiments, the refractory blocks of the wall lining are preferably carbon blocks.

According to a further embodiment, the junction surfaces between adjacent ceramic blocks are progressively more globally inclined from the center toward the periphery of the bottom lining, so that any block is partially surmounting a block inwardly adjacent. Preferably, the junction surfaces are flat inclined surfaces for the inner rings, and stepped surfaces or sloped curved for the outer rings.

In the frame of any of the alternatives using large-size ceramic blocks in the bottom lining, a special attention is needed for the joints between these blocks. For avoiding thermo-mechanical damages, the thickness of the joints between these blocks, to be filled with ceramic mortar, is between 0.7 and 1.5%, preferably 0.8 to 1.2%, of the concerned block dimension, i. e. the adjacent block dimension taken in the direction perpendicular to the concerned joint plan.

Finally, the present invention also proposes a method for producing ceramic elements, which is an independent aspect of the present disclosure.

The method for impermeation of ceramic refractory material comprising a granular phase made of a silico-aluminous high alumina content granular material and a binding phase for binding grains of said granular material, comprise, as a preliminary step, providing a non-baked (green) ceramic element, e.g. based on granular andalusite or chamotte or synthetic mullite, which contains in its matrix the elements silicon, aluminum, oxygen and nitrogen, in an adequate range of ratii able to generate SiAlON bond. Then, impermeation is achieved by baking in pure nitrogen atmosphere ("nitrogen firing") this non-baked (green) ceramic element into a ceramic element comprising a microporous ceramic bonding phase or matrix (phase between the grains) that preferably has a permeability ≤2 nanoperms. The proposed baking in nitrogen atmosphere treatment achieves a high-temperature resistant microporosity and thereby virtual imperviousness with respect to molten pig iron.

Elements, in particular comparatively large blocks, produced with this method for impermeation, i.e. rendering substantially impervious to molten pig iron, are particularly well suited for use in the refractory lining of a metallurgical furnace hearth, especially a blast furnace hearth.

The features mentioned hereinabove in relation to baking in nitrogen atmosphere equally apply to this independently claimed method. Particularly, said general method can be used for producing microporous ceramic elements usable in an upper region of a bottom lining of a earth as previously defined, the method then comprising providing prefabricated blocks made of granular andalusite or granular chamotte or granular corundum or granular synthetic mullite and a binding phase containing one or more of silicon, aluminum, oxygen and nitrogen, and baking said blocks in nitrogen atmosphere.

To produce large size microporous ceramic blocks, the prefabricated blocks are large-size prefabricated blocks having an upper side and a lower side and comprising at least one blind hole made at said lower side so that substantially any point within the ceramic material is at a distance from a free surface of a block lower than a maximum penetration depth of impermeation achievable by said baking.

Especially provision of one or more blind holes, in particular in the non-baked elements, is considered beneficial for manufacturing large-size blocks.

BRIEF DESCRIPTION OF THE DRAWINGS

Preferred embodiments of the invention will now be described, by way of example, with reference to the accompanying drawings in which.

DETAILED DESCRIPTION WITH RESPECT TO THE DRAWINGS

Figure 1:
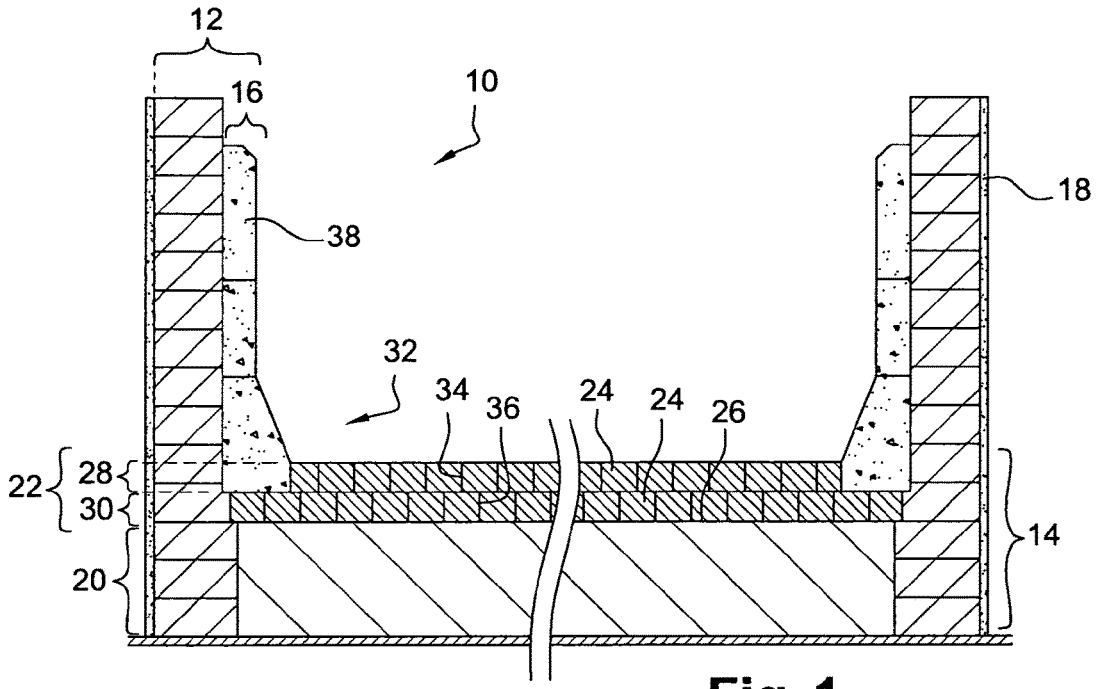
FIG. 1 is a vertical cross sectional view of a blast furnace hearth illustrating a bottom lining, wherein the ceramic elements of the upper region comprise microporous bricks or comparatively small blocks.

FIG. 1 illustrates a generally cylindrical hearth 10 of a blast furnace (not fully shown), more specifically the lower hearth region below the tuyeres (not shown). The hearth 10 comprises a lateral wall lining 12 and a lower bottom lining 14 which are made of refractory material that resists to very high temperatures >1500° C. to contain the bath of molten pig iron produced by the blast furnace process. The wall lining 12 comprises an innermost additional lining 16. In typical manner, a surrounding outer shell 18, e.g. of cylindrical shell, is made of steel to contain and mechanically maintain the wall lining 12 and the bottom lining 14. The wall lining 12 and the bottom lining 14 respectively form the lateral boundary and the lower boundary of the useful volume of the hearth 10. As further illustrated in FIG. 1, the bottom lining 14 comprises a lower region 20 and an upper region 22 that is arranged to cover the top of the lower region 20. When made of ceramic material, the upper region 22 is often called "ceramic pad".

Although not illustrated in detail in FIG. 1, the lower region 20 comprises any conventional carbon based construction. The lower region 20 may for example be built of, starting from the bottom plate of the bottom lining, a ramming mass, a safety graphite layer, which is about 100 to 200 mm thick, and a carbon layer, which is about 1 m thick, of two or three superposed courses of thermally conductive carbonaceous refractory blocks.

The upper region 22 of the bottom lining 14 however has a specific configuration in accordance with the present invention. As seen in FIG. 1, the upper region 22 comprises an uninterrupted horizontal layer of a plurality of ceramic elements 24 that completely covers the top surface 26 of the conventionally configured lower region 20, i.e. the top surface 26 that would be exposed to the bath in the heart 10 in the absence of the upper region 22. Accordingly, the surface covered by the upper region 22 corresponds to the disc-shaped area that is circumferentially delimited by the wall lining 12 in the lower region 20. In the embodiment of FIG. 1, the layer of ceramic elements 24 is built of a masoned pavement-like assembly made mostly of comparatively small blocks, e.g. bricks or blocks having dimensions exceeding 100×250×500 mm, with the block being typically arranged with their lengthwise axis oriented in vertical direction. In the border region adjacent the wall lining 12, smaller elements can be used. More specifically, the upper region 20 comprises two superposed horizontal courses 28, 30 (i.e. planar strata) of blocks in staggered arrangement. The geometrical layout of the elements 24 into courses 28, 30 is of any known suitable type, e.g. a conventional "herring bone" layout. Besides the ceramic elements 24 as such, the upper region 22 comprises cement based vertical joints 34, 36 between the elements 24 of conventional material and configuration and horizontal cement joints in between the courses 28, 30 and between the lower course 30 and the lower region 20. Staggering the elements 24 of the course 28 with respect to those of the course 30 enables a more stable assembly and increases the tightness against molten pig iron. As will be understood from the foregoing, the upper region 22 forms a coherent uninterrupted barrier or separation between the bath to be contained in the hearth 10 and the conventionally configured lower region 20. Accordingly, the upper region 22 warrants a durably maintained position of the pig iron solidification isotherm in the upper region 22 (i.e. within the pad). In addition, the ceramic barrier of the upper region 22 provides additional protection against carburization dissolution of carbon refractory in the lower region 20, especially in case the bath in the hearth 10 is not saturated in carbon (e.g. in view of reducing carbon oxide emissions).

As will be appreciated, each of the ceramic elements 24 are based on microporous ceramic material, i.e. material having a permeability ≤2 nanoperms, preferably ≤1 nanoperm (metric—measured using a method according to ISO 8841:1991 "Dense, shaped refractory products—Determination of permeability to gases"). More preferably, the ceramic elements 24 essentially comprise microporous material and have a mean pore with mean pore width ≤2 μm (measured using a method according to DIN 66133: "Determination of pore volume distribution and specific surface area of solids by mercury intrusion").

The protective layer of refractory elements 24 enable long-term maintenance of the level of the pig iron solidification isotherm (e.g. at 1150° C.), ideally within the upper region 22 during the entire furnace campaign. Moreover, and as will be appreciated, compared to protective layers made of conventional ceramics, the proposed upper region 22 with the covering layer of microporous ceramic material provides a durably raised level of the mentioned solidification isotherm as set out hereinabove. In addition, it is theorized that microporous refractory elements 24 will be less subject to wear and thus have longer service life due to improved resistance, e.g. to chemical attack by alkalies. As a consequence, the service life of the lower region 20 is significantly increased by virtue of microporous elements 24 in the upper region 22 in accordance with the invention.

As further seen in FIG. 1, the wall lining 12 is equipped with an innermost additional assembly of ceramic elements 38 which may also be made of microporous ceramics. Together with the ceramic elements 24, the ceramic elements 38 can form a ceramic cup 32 providing an "artificial high-quality skull" protecting the main refractory construction of both the wall lining 12 and of the bottom 14 of the hearth 10. It is to be noted that ceramic materials also minimize heat losses in comparison with conventional refractories, such that more energy-efficient operation is possible when providing a ceramic cup 32. The microporous quality of the ceramic elements 24 is expected to significantly decrease at long term thermal conductivity compared to conventional ceramic refractories.

Suitable microporous ceramic elements 24 of low-permeability can be produced using any known method, e.g. conventional hydraulic binding of preformed cast blocks based on granular andalusite (aluminum nesosilicate mineral $Al_2SiO_5$) or synthetic mullite.

Preferably however, ceramic elements 24 of low thermal conductivity as well as thermally stable very low permeability, e.g. <1 nanoperm, are obtained by baking in nitrogen atmosphere.

The ceramic elements 24 are preferably manufactured using suitable fine additives that, after baking in nitrogen atmosphere ("nitrogen firing" or "nitride hardening") provide a high-temperature resistant permanent microporosity. In addition to decreasing the mean free width of the pores and thereby "impermeating" the material, this treatment can provide ceramic material, in particular SiAlON ceramics, with a better resistance to chemical attack, e.g. by alkaline substances, than non-nitrided ceramic materials. Large microporous ceramic elements 24 are preferred and obtained by baking in nitrogen atmosphere of prefabricated blocks. Suitable prefabricated (green) blocks can be based on high alumina content granular material. More preferably however, in view of reduced cost and reduced thermal conductivity, the blocks can be based on andalusite, synthetic mullite or chamotte granular material, e.g. chamotte with an $Al_2O_3$ content of 55-65% by weight, in particular 60-63% by weight. These three alternatives are considered to confer microporosity that remains reliably stable at high temperatures in excess of 1400° C. as may occur in the hearth. Preferably, the prefabricated blocks are composed so as to obtain a microporous SiAlON bonded ceramic, i.e. a sort of matrix (bonding phase) made of "ceramic alloy" based on the elements silicon (Si), aluminum (Al), oxygen (O) and nitrogen (N), introduced adequately into the grog (initial mix before baking), which is subsequently baked in nitrogen atmosphere. Whereas SiAlON bonded ceramics are known for their resistance to wetting or corrosion by molten non-ferrous metals, they have also been found beneficial in case of ferrous metal, e.g. in a pig iron producing blast furnace.

In FIG. 1, the ceramic elements 24 are for instance made of pre-fabricated andalusite based blocks, with ca. 55-65, in particular 60-63, wt. % $Al_2O_3$ content, that have been impermeated by baking in nitrogen atmosphere, i.e. by surrounding the grains of the granular material with a SiAlON bonding phase.

Figure 2:
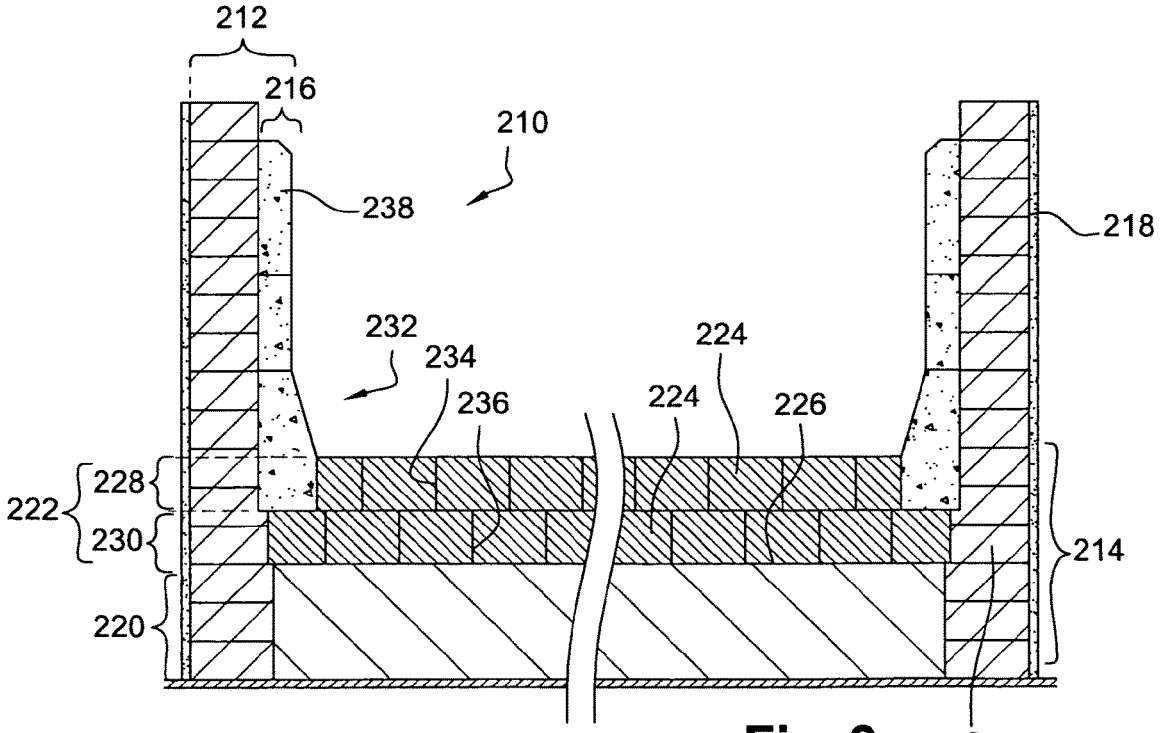
FIG. 2 is a vertical cross sectional view of a blast furnace hearth illustrating a bottom lining, wherein the ceramic elements of the upper region comprise microporous large-size blocks.

FIG. 2 shows an alternative embodiment of a hearth 210, in which only the configuration of the upper region 222 of the bottom lining 214 differs from the above-described hearth. In FIG. 2, the lower region 220 comprises any conventional carbon based construction, and the ceramic elements 224 are made of pre-fabricated blocks based e.g. on granular andalusite, on chamotte or on corindon also transformed into a microporous SiAlON bonded ceramic, by baking in nitrogen atmosphere. Permeability measurements also revealed permeability of <2 nanoperm.

As will be appreciated, the layer of refractory elements 224 schematically shown in FIG. 2 is made of two courses, built essentially of relatively large-sized blocks having a volume typically in excess of 20 $dm^3$ and, typically dimensions of at least 400×200×500 mm (height×width×length), however with at least one dimension significantly exceeding 200 mm. Typically, the layer 224 is made of two courses of blocks arranged with a 400 mm vertical extent, or even two courses of 500 mm vertical extent. Taking into account that the recommendation is to have a total thickness greater than 500 mm, the layer of refractory may also be made of only one course of large blocks.

Independently of the foregoing, the present disclosure also proposes a configuration and impermeation method for producing large-size blocks 224 with highly homogenous microporosity throughout the constituent material.

Figure 3A:
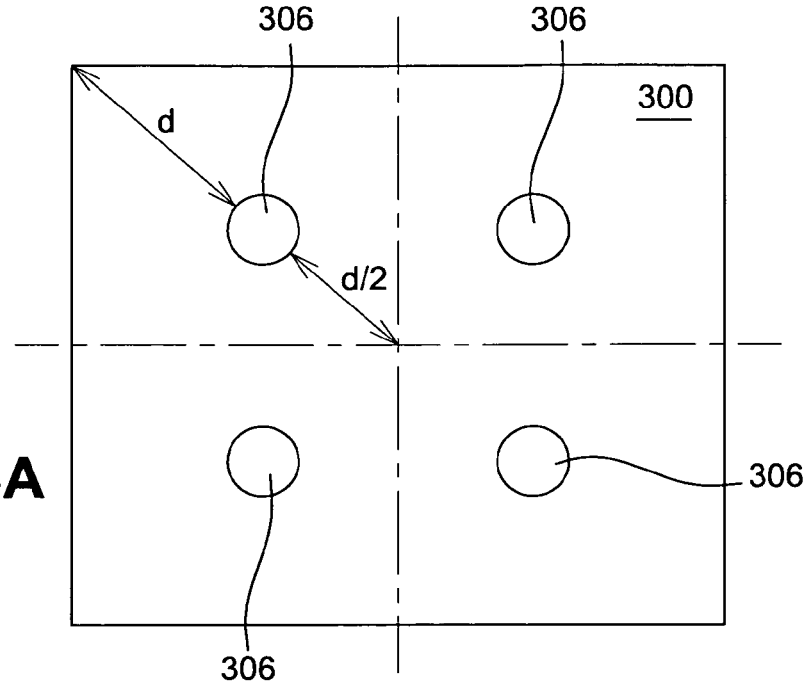
FIG. 3A-3B show a large-size refractory block in bottom view and vertical sectional view respectively, which block is specially adapted for the manufacture of large-size blocks as used in the embodiment of FIG. 2.
Figure 3B:
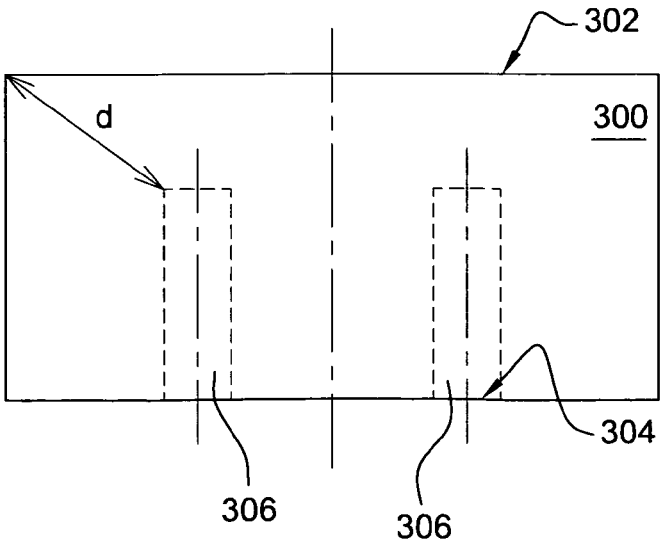

FIG. 3A-B illustrate a suitable non-baked (green) block 300, e.g. based on granular andalusite shaped by ramming or vibration molding. With respect to its orientation when installed, the generally parallelepiped block 300 has an upper side 302 and an opposite lower side 304 (base). As seen in the cross-section of FIG. 3A, the block 300 is molded so to have blind holes 306, which are preferably slightly conical for molding purposes. The blind holes 306 open into the lower side 304 and stop short of its upper side 302 at a distance d. Moreover, as seen in rear view of FIG. 3B, the large-size blocks have four (or any other suitable number depending on the size and shape) blind holes 306, which have a diameter of e.g. 10-50 mm, typically about 20 mm. The blind holes 306 are regularly arranged so as to be separated at a regular maximum distance d (e.g. on the diagonal of the rectangular lower side 304) from each other and from the outer faces. The distance d is chosen slightly smaller than twice the maximum achievable penetration depth of the chosen impermeation process. When using nitride hardening, d is typically 100-200 mm. Thanks to the blind holes 306, homogeneous baking in nitrogen atmosphere of large-size blocks is possible. After baking in nitrogen atmosphere of the large-size blocks 300, the slightly conical blind holes 306 are preferably closed by ramming. As preferred ramming mass, a granular mass similar to the ceramic material of the non-baked block, preferably suitable for phosphatic hardening (hardening due to a phosphate reaction with a matrix constituent), is used. Such ramming mass confers high temperature resistance and durability. Lifting holes, well known in the prior art, made on the upper side of the blocks, ca also participate to an efficient nitride hardening.

Figure 4:
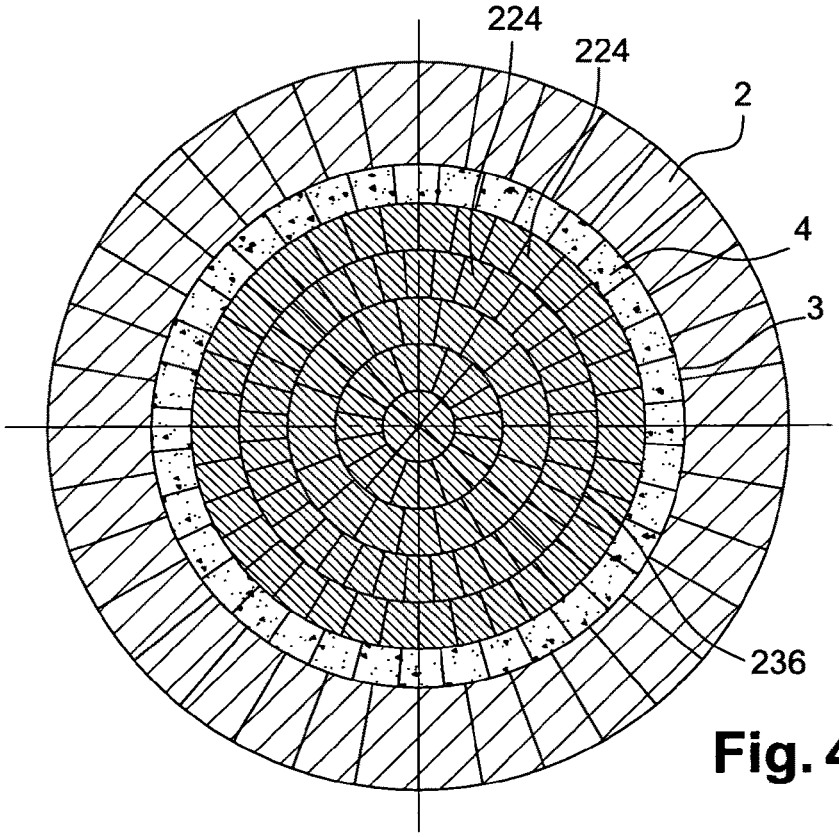
FIG. 4 is a plan view of a first embodiment of the bottom lining, made of large ceramic blocks disposed in concentric rings.
Figure 5:
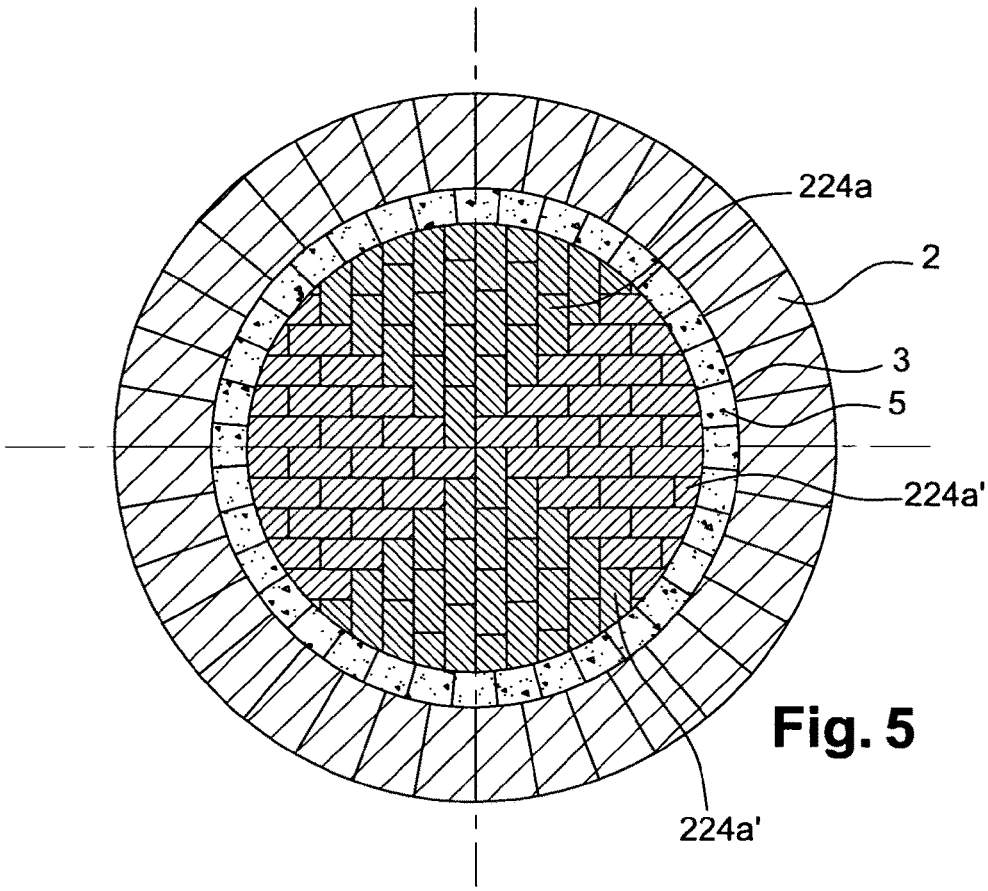
FIG. 5 is a plan view of a second embodiment of the bottom lining, made of large ceramic blocks disposed in herringbone design, the blocks of the wall lining being disposed in a ring.
Figure 6:
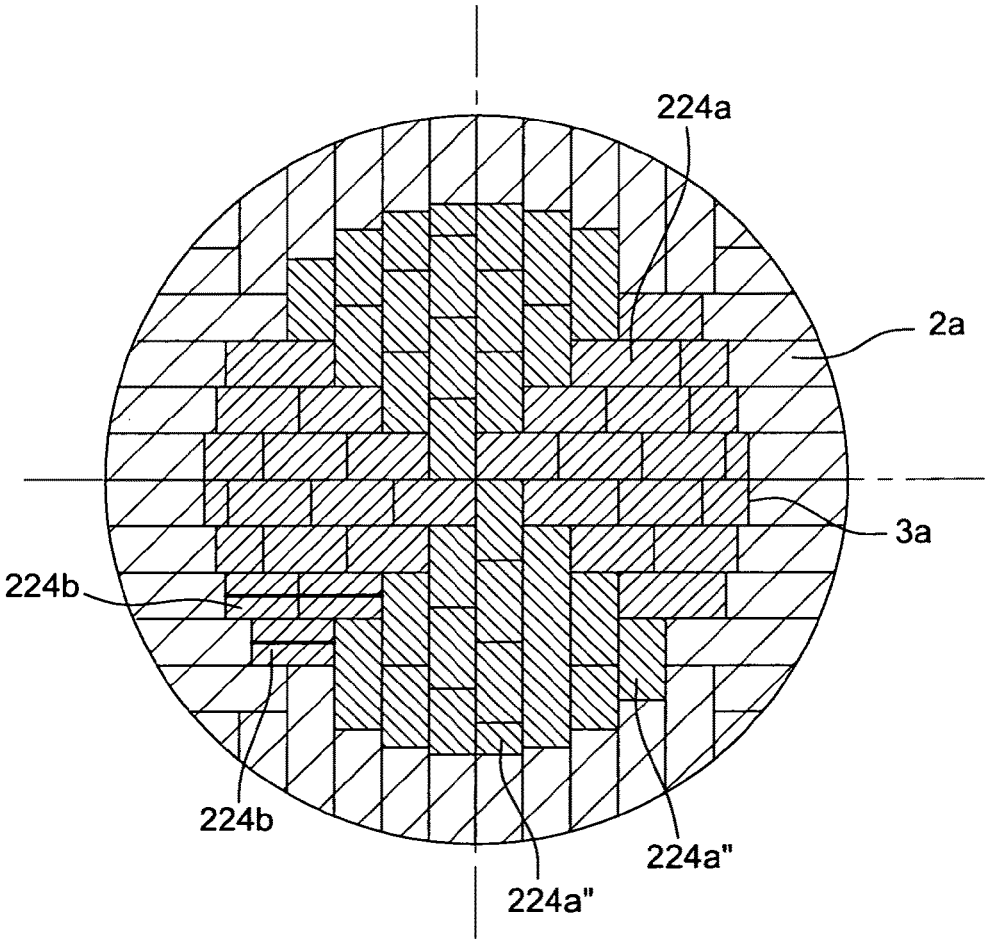
FIG. 6 is a plan view of a third embodiment of the bottom lining made of large ceramic blocks disposed in herringbone design, the blocks of the wall lining being disposed in a matching stepped design.

FIG. 4 to 6 illustrates three alternatives design of bottom linings according to the invention; made of large-size ceramic blocks.

In the first preferred design presented on FIG. 4, the ceramic blocks 224, having for instance a mean width of 500 mm in the circumferential direction, are designed in concentric rings parallel to the ring of surrounding carbon blocks 2 of the wall lining. The outer ring 4 of ceramic blocks, preferably of same composition, is designed for obtaining an adequate accommodation with the surrounding carbon blocks 2, by means of a thick joint 3 having a thickness of 50 mm for example.

In the designs presented on FIGS. 5 and 6, the ceramic blocks 224*a* are lined up in two perpendicular directions. This design, often called the "herring bone design" advantageously allows to give identical rectangular shape and dimensions to many blocks, thus reducing the mound costs.

When the surrounding carbon blocks 2 are of circular design, as shown on FIG. 5, an intermediary ring 5 of circular design is recommended between the "herring bone" blocks 224*a* and said carbon blocks. Only the blocks 224*a*' situated at the periphery, adjacent the intermediary ring 5, need to be given a specific shape. Preferably, the ceramic blocks of ring 5 are of the same composition as the blocks 224*a*, or possibly better.

On the contrary, when the carbon blocks 2*a* are designed, as shown on FIG. 6, according the so-called "stair shaped parallel beams", then a direct accommodation with the carbon blocks, including the needed thick joint 3*a* can be used, providing that the width of the ceramic blocks 224*a* is adapted to the width of the carbon blocks. However, ceramic blocks having a different width, for example ceramic blocks 224*b* of half-width, can also be used if needed.

Only the length of some ceramic blocks 224*a*" needs to be adapted to ensure accommodation with the surrounding carbon blocks 2*a*, using there thick joints 3*a*.

As already mentioned, a special attention is needed for the joints between the large-size ceramic blocks of the above examples. For example, in the case of the design of concentric rings of FIG. 4, the block length in the radial direction is 600 mm. Then, the joint thickness of the joint 234, 236 between 2 consecutive rings is 1% of said length, that is 6 mm.

Figure 7:
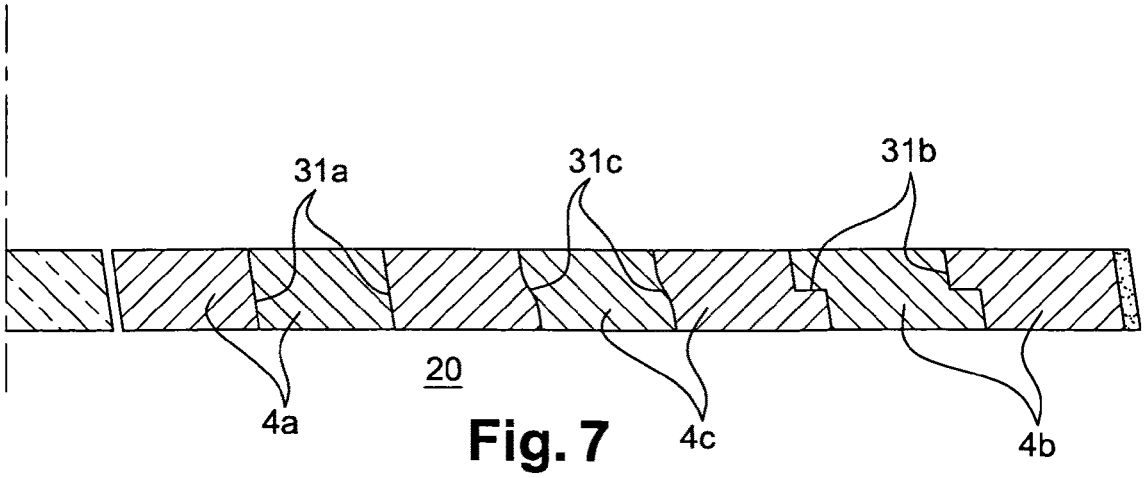
FIG. 7 is a radial cross sectional view of the bottom lining of FIG. 4, sharing different examples of vertical joints between ceramic blocks.

The junction surfaces of the joints can be either flat inclined surfaces (31*a*) or curved slopped surfaces (31*c*) or stepped surfaces (31*b*) as shown on FIG. 7. Preferably these joints are progressively more globally inclined joints from the center toward the periphery of the bottom lining, an important aspect being that the border of any block directed toward the axis A is surmounting the adjacent border of the adjacent block, so that a sort of arching effect, favorable to a better maintain of the blocs, is obtained by blocking successively the different rings from the center to the exterior ring. All the joints can have a same form as mentioned above. FIG. 7 show examples, in a non-limitative way, of the joints between the different rings of a lining in concentric rings, disposed above the lower region 20 of carbon lining. The axis A of the hearth is on the left side of the drawing. The progressive inclination of the joints is here obtained by a joint surface 31*a* between the blocks of the inner rings 4*a* substantially flat; the joint surface 31*c* between the blocks of the intermediary rings 4*c* gives an example of sloped curved; and the joint surface 31*b* between the blocks of the outer rings 4*b* gives an example of stepped interface. In practice, either slopped curved or stepped interfaces will be used, not both of them, in a given bottom.

The invention claimed is:

1. A hearth for a metallurgical furnace comprising:

a wall lining and a bottom lining that are made of refractory material for containing a bath comprising molten metal;

said bottom lining having a lower region comprising a carbon refractory layer and an upper region that comprises a layer of ceramic elements arranged to cover said lower region wherein said ceramic elements of said upper region are made of microporous ceramic material comprising a granular phase made of a silico-aluminous high alumina content granular material and a binding phase for binding grains of said granular material, said microporous ceramic material having a thermal conductivity lower than 7 W/m.° K; a permeability ≤2 nanoperms and a mean pore width ≤2 μm, wherein said wall lining delimits a substantially horizontal top surface of said lower region and said layer of ceramic elements is an assembly that comprises bricks or blocks and that completely covers said top surface, wherein the ceramic elements are large-size blocks, measuring more than 200×400×500 mm, having a first part made of ceramic material baked in nitrogen atmosphere, said first part having an upper side and a lower side and comprising at least one conical blind hole disposed in the blocks, the at least one blind hole being open into said lower side, and a second part made of a refractory material rammed in said blind holes, the blind holes being arranged so that any point located in the ceramic material of the first part is at a distance from a surface of said first part lower than a maximum penetration depth of impermeation achievable by a baking process used for producing said blocks.

2. The hearth as claimed in claim 1, wherein said microporous ceramic material has a permeability ≤1 nanoperm.

3. The hearth as claimed in claim 1, wherein said microporous ceramic material has a mean pore width ≤1 μm.

4. The hearth as claimed in claim 1, wherein the granular phase comprises one or more of the followings: andalusite, chamotte, corundum, synthetic mullite.

5. The hearth as claimed in claim 4, wherein the granular phase comprises granular andalusite with an $Al_2O_3$ content of 55-65 wt %.

6. The hearth as claimed in claim 1, wherein the binding phase comprise a nitrided bond.

7. The hearth as claimed in claim 6, wherein the binding phase is based on silicon, aluminum, oxygen and nitrogen, in a range of ratii configured to generate a SiAlON bond.

8. The hearth as claimed in claim 1, wherein the ceramic elements are large-size ceramic blocks, measuring more than 200×400×500 mm, disposed in a herringbone pattern.

9. The hearth as claimed in claim 8, wherein the wall lining comprise, at the same level as said upper region, refractory blocks matching with said large-size ceramic blocks in said herringbone pattern, each alignment or group of alignments of ceramic blocks prolonging toward the periphery of the wall lining by one said refractory block.

10. The hearth as claimed in claim 8, wherein the wall lining comprise, at the same level as said upper region, a first annular row of refractory blocks disposed circumferentially side by side, and a second annular row of microporous ceramic blocks disposed circumferentially side by side is disposed between the first annular row of refractory blocks and the large-size ceramic blocks disposed in a herringbone pattern.

11. The hearth as claimed in claim 1, wherein the wall lining comprise, at the same level as said upper region, an first annular row of refractory blocks disposed circumferentially side by side, and the ceramic elements are large-size ceramic blocks disposed in concentric annular rows wherein each of said annular rows is constituted of microporous ceramic blocks disposed circumferentially side by side, the outer annular row of ceramic blocks being joined to the first annular row by a ramming material.

12. The hearth as claimed in claim 9, wherein said refractory blocks are carbon blocks.

13. The hearth as claimed in claim 11 wherein the junction surfaces between adjacent ceramic blocks are progressively more globally inclined from the center toward the periphery of the bottom lining, so that any block is partially surmounting a block inwardly adjacent.

14. The hearth as claimed in claim 11 wherein the junction surfaces are flat inclined surfaces or curved slopped surfaces or stepped surfaces.

15. The hearth as claimed in claim 1, wherein the ceramic elements are large-size ceramic blocks, measuring more than 200×400×500 mm, determining therebetween joints filed with ceramic mortar, a joint between any adjacent blocks having a width of 0.7 to 1.5% of the adjacent blocks dimension taken in the direction perpendicular to that of the joint.

* * * * *